United States Patent [19]

Koya et al.

[11] Patent Number: 4,681,151

[45] Date of Patent: Jul. 21, 1987

[54] METHOD FOR PRODUCTION OF FIBER-REINFORCED METAL COMPOSITE MATERIAL

[75] Inventors: Yoshihiro Koya, Yamato; Toshiaki Katayama, Yokohama, both of Japan

[73] Assignee: Mitsubishi Chemical Industries Limited, Tokyo, Japan

[21] Appl. No.: 911,878

[22] Filed: Sep. 26, 1986

[30] Foreign Application Priority Data

Oct. 22, 1985 [JP] Japan ..... 60-235695

[51] Int. Cl.[4] ..... B22D 19/14

[52] U.S. Cl. ..... 164/76.1; 164/97; 164/110

[58] Field of Search ..... 164/76.1, 97, 108–110

[56] References Cited

FOREIGN PATENT DOCUMENTS 56-111565 9/1981 Japan ..... 164/97

*Primary Examiner*—Kuang Y. Lin

*Attorney, Agent, or Firm*—Oblon, Fisher, Spivak, McClelland & Maier

[57] ABSTRACT

A method for production of fiber-reinforced metal composite material having high fiber content, wherein a bundle of fiber material is impregnated with water, then this water-impregnated fiber bundle is subjected to compression and freezing to form a high density fiber shaped body, subsequently, the high density fiber shaped body is subjected to thawing and drying, while maintaining its shape as compressed, and finally molten metal is infiltrated into the fiber shaped body.

3 Claims, 4 Drawing Figures

METHOD FOR PRODUCTION OF FIBER-REINFORCED METAL COMPOSITE MATERIAL

This invention relates to a method for production of fiber-reinforced metal composite material. More particularly, it is concerned with a method for production of such fiber-reinforced metal composite material that has high content of the reinforcing fiber.

In recent years, the fiber-reinforced metal composite material (hereinafter abbreviated, where necessary and appropriate, as "FRM") using those inorganic fibers and metal fibers such as silicon carbide, aluminum oxide, etc.; carbon fibers; and so on, as the reinforcing material, and various metals as the matrix material has drawn attention of all concerned as being suited for the refractory structural material having high specific strength and high specific rigidity, or as being suited for the material having the wear-resistant property and the function of utilizing its low thermal expansion coefficient.

In general, the fiber-reinforced metal composite material to be used for such purpose is required to have high tensile strength, bending strength, and so forth; and, in order to obtain these various physical properties with the FRM, there has been expected emergence of such production method which not only improves the strength of the fiber per se as the reinforcing material, but also provides the FRM of high fiber content, and effectively utilizes the strength of the fiber as the reinforcing material. Here, the mechanism of the FRM to develop its strength is understood in such a way that the fiber mainly shares the stress loaded on it, and that the matrix metal plays a role of transmitting the stress to the individual fiber to enable it to share the stress uniformly. Accordingly, the form of the FRM should be such that the fibers are uniformly distributed in the matrix metal to be entirely surrounded by it without leaving therein any voids or foreign matters whatsoever at the interface between the fibers and the matrix metal, which are liable to hinder the transmission of the stress. Also, the method for producing such FRM composite material should be such that the fibers do so, as a matter of course, bring about deterioration from their reaction with the matrix metal in th atmosphere of its production to obtain the required form of the FRM as mentioned above, and, in addition, the matrix metal perfectly fills up the narrow space gaps among the fibers to satisfactorily attain the bonding of the interface between the matrix metal and the fibers.

At present, the method for production of the fiber-reinforced metal composite material is roughly divided into the so-called "diffusion-bonding method" which utilizes readiness in viscous fluidity and diffusion of the matrix metal at a high temperature, and the so-called "infiltration method" which utilizes the fluidizing property of the molten metal. According to the former method of diffusion-bonding, the matrix metal tends to be insufficiently charged when the FRM of high fiber content is manufactured, with the consequence that defects are rather introduced into the product, which makes it very difficult to attain the high fiber content.

On the other hand, in the latter method of infiltration, there has been practiced the casting of molten metal in conjunction with vacuum or its compression under a high pressure, whereby the molten metal can be sufficiently penetrated into the space gaps among the fibers such as carbon fibers having poor wetting property with the molten metal with the result that the FRM of high fiber content can be manufactured. At the time of manufacturing the FRM of high fiber content by the infiltration method, a high density preform of a collected body (or bundle) of the reinforcing fibers is once formed. The reason for this is that the reinforcing fibers are difficult to maintain high density owing to their high rigidity or repulsion among the fibers or the fiber bundles.

Therefore, the fiber bundles are usually impregnated with epoxy resin, etc. as the binding agent, followed by curing the same to bring it to high density, thereby forming the preformed body.

Subsequently, this preformed body is placed in a shaping mold to remove the resin, etc. as the binding agent, after which the molten metal is poured into the mold by the infiltration method to manufacture the FRM composite material.

In such method, however, with a view to removing the resin, etc. as the binding agent from the preformed body, it has so far been the practice to dissolve the resin component with a solvent, or to subject the preformed body to heat-treatment under a reduced pressure or in an inert gas atmosphere. Either method, however, was difficult to perfectly remove the binder component, because the binder component remains in the space gaps among the fibers or on the surface of the fibers to hinder charging of the matrix metal into the fiber gaps as well as bonding between the matrix metal and the fibers, hence the FRM composite material having highly excellent characteristics could not be obtained.

With a view to solving, therefore, the problems inherent in the conventional method for production of the FRM composite material, the present inventors eagerly pursued researches and studies, as the result of which they discovered that the above-mentioned points of problem could be solved by adopting the expedient of freezing the fiber bundles, which is effective as the method for eliminating the residual binder component on the surface of the fibers or in the space gaps among them in the process steps of maintaining the fiber bundle at high density and infiltrating the matrix metal into such fiber bundle. Based on this finding, they arrived at the present invention.

That is to say, the object of the present invention is to provide a simple method of producing the FRM composite material of high fiber content having excellent properties.

The above-mentioned object of the present invention can be attained by the method for production of fiber-reinforced metal composite material, wherein the fiber bundle is firstly impregnated with water; then the water-impregnated fiber bundle is subjected to compression and freezing to form a shaped body of fibers having high density; thereafter, while maintaining the shaped body in its as-shaped configuration, it is thawed and dried; and finally, molten metal is poured into the fiber shaped body.

BRIEF DESCRIPTION OF THE DRAWING

One way of carrying out the invention is described in detail hereinbelow with reference to the accompanying drawing which illustrates a specific embodiment of the invention, in which.

DETAILED DESCRIPTION OF THE INVENTION

Figure 1:
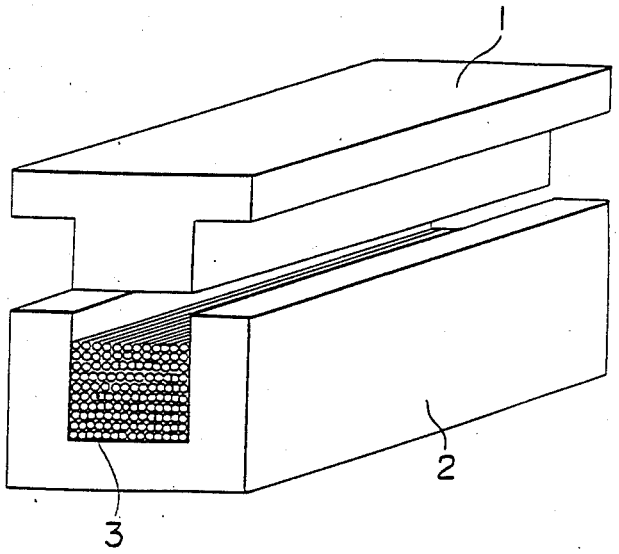
FIGS. 1*a* to 1*d* illustrate the operating steps of the method according to the present invention.
Figure 1:
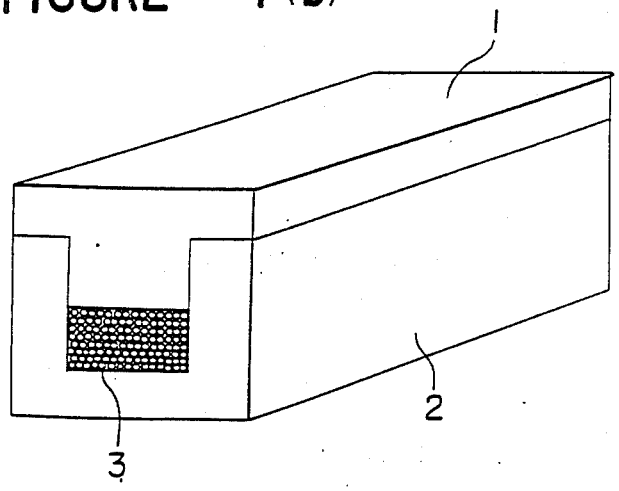
Figure 1:
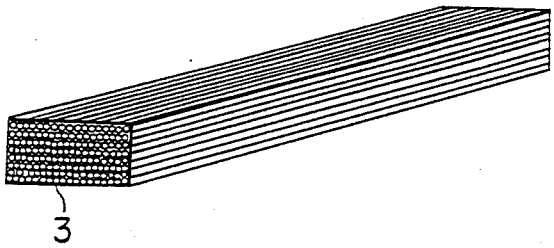
Figure 1:
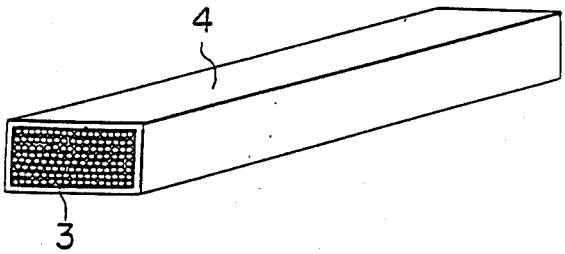

The fiber material to be used for the present invention is not limited to any special class of materials, but any kind of materials may be equally used, provided that they are suited for the manufacture of the FRM composite material in general. Concrete examples of such fiber material are: inorganic fibers of silicon carbide, aluminum oxide, boron, etc.; and carbon fibers.

The collected body (or bundle) of fibers is formed by arranging the fibers (either long fibers or short fibers) in a certain definite direction, or by collecting them in random direction as in a felt-form.

Incidentally, when the fibers constituting the fiber bundle have on their surface a sizing agent or other oil agent, it is necessary that the fiber bundle be formed only after such oil agent has been removed by use of a solvent or the like.

In the next place, such fiber bundle is impregnated with water, and then the water-impregnated fiber bundle is placed in a molding frame, after which it is compressed and frozen to be formed into high density shaped body of the fiber material. The water as impregnated into the fiber bundle is therefore cooled and turns into ice which plays a role of maintaining the shape of the fiber bundle as compressed and densified. The water to be used for this purpose may be sufficient to have a purity of such an extent that no foreign matters will remain among the fibers after the thawing and drying steps, hence it may not necessarily be chemically pure water.

The compressing operation on the fiber bundle should preferably be done in such a manner that it may be subjected to the densifying treatment so as to give a desired volume ratio (Vf) of the fiber to the intended FRM composite material; on the other hand, the freezing operation should preferably be done rapidly in, for example, a bath of ethanol and dry ice, or in liquid nitrogen so as not to bring about drying of the moisture in the fiber.

Subsequently, the thus obtained high density shaped body of fiber is placed in a shaping mold to subject it to thawing and drying to thereby remove the water in the shaped body. At this instance, the rate of the temperature elevation is not particularly limited so far as it does not give mal-effect to the fibers. Further, the heating temperature may be such that the water is perfectly removed.

Subsequent to preheating of the dried high density shaped body obtained in the above-described manner, molten metal is poured into this shaped body to produce the FRM composite material according to the present invention. Such infiltration operation may be done in accordance with the known methods. While there is no particular restriction to the metal material to be used for this purpose, use of aluminum, magnesium, copper, or alloys of these metals are preferable.

Incidentally, it should be noted that, in the foregoing explanations, each operating step is described to be done as a single operating step. However, it is of course possible that these operating steps may be done continuously be compressing and freezing the fiber bundles in a shaping mold to form a high density shaped body of fiber, in advance, and then this shaped body is subjected to the thawing and drying treatment, followed by the preheating for the infiltration operation.

According to the present invention, the FRM composite material of the high fiber content can be obtained in a simple method of freezing the impregnated water in the fiber bundle, and then thawing and drying the frozen water. Therefore, in comparison with the conventional method, it does not require the complicated steps of resin-impregnated and resin-removal, and further it has no foreign matters remaining in the space gaps among the fibers after removal of water by drying. Consequently, the method according to the present invention enables molten metal to sufficiently penetrate into the space gaps among those fibers such as carbon fibers having poor wettability with molten metal, so that the FRM composite material of excellent characteristic can always be obtained. The method of the present invention is particularly suited for the production of the FRM composite material having 40% or more of the volume ratio (Vf) for the fiber material.

In the following, the present invention will be explained more specifically in reference to a preferred example thereof in conjunction with a comparative example, although the invention is not limited to this example alone so far as it does not depart from the ambit of the invention as recited in the appended claims.

EXAMPLE 1

Water was impregnated in a fiber bundle of pitch-type carbon fiber, from which surface the sizing agent, etc. had been removed. Then, the water-impregnated fiber bundle was cut into a length of 70 mm. Next, as shown in FIGS. 1*a* and 1*b*, this cut fiber bundle (3) was arranged in a certain definite direction and placed in a molding cavity (2) in a quantity corresponding to 70% of the total volume of the intended FRM composite material; subsequently, this fiber bundle was compressed by use of a molding projection (1) until it reached the fiber volume ratio (Vf) of 70%, after which both molding cavity and molding projection were fastened together by screw-threaded bolts.

Thereafter, the fiber bundle in its compressed state as mentioned in the preceding was subjected to freezing in a bath of ethyl alcohol and dry ice at a temperature of about −50° C. Then, the molding cavity (2) and the molding projection (1) were separated to thereby obtain the frozen high density fiber shaped body having the fiber volume ratio of 70%, as shown in FIG. 1*c*.

The fiber shaped body thus obtained was then placed in a shaping mold of stainless steel (4) as shown in FIG. 1*d*, followed by heating the same at 200° C. to carry out thawing and evaporating the water in the fiber shaped body. The sufficiently dried high density fiber shaped body was preheated to 400° C., after which the infiltration treatment was effected on this fiber shaped body with use of aluminum alloy having a melt temperature of 800° C. under an infiltration pressure of 860 kg/cm$^2$ and at a temperature of from 250° C. to 350°, thereby obtaining the FRM composite material according to the present invention.

As the result of observation through an optical microscope of the cross-section of the FRM composite material in the direction of the fiber axis, it was verified that the matrix metal had been uniformly impregnated in the space gaps among the fibers, but no voids nor foreign substances remaining between the fibers and the matrix metal.

From this FRM composite material, a specimen plate having a dimension of 1.0 mm thick, 10 mm wide, and 65 mm long was cut out, and it was subjected to the bending test. The results of the test are shown in Table 1 below.

COMPARATIVE EXAMPLE 1

A bundle of carbon fibers same as the pitch-type carbon fibers as used in Example 1 above was immersed into a 15% conc. solution composed of thermosetting epoxy resin and methyl ethyl ketone. The fiber bundle was then compressed in the shaping mold in the same manner as in Example 1 above so that it may have the fiber volume ratio of 70%, under which condition the shaping mold was unmovably fastened. Subsequently, the fiber bundle in its state as compressed was heated at a temperature of 150° C. for five hours to cure the epoxy resin, followed by separating the mold halves to obtain the preformed body having the fiber volume ratio of 70%. The preformed body was then placed in the shaping mold of stainless steel, heated in the air at a temperature of 400° C. for three hours, and then further heated at a temperature of 850° C. for ½ hour in an argon atmosphere, thereby decomposing the epoxy resin with gas.

The preformed body, from which the epoxy resin had been removed, was processed into the FRM composite material under the same conditions as in Example 1 above.

As the result of observation through an optical microscope of the thus obtained FRM composite material in its cross-section in the direction of the fiber axis, it was verified that, while the matrix metal had been uniformly impregnated in the space gaps among the fibers, residues of the epoxy resin (carbon) were present between the fibers and the matrix metal.

From this FRM composite material, a specimen plate having a dimension of 1.0 mm thick, 10 mm wide, and 65 mm long was cut out, and subjected to the bending test. The test results are shown in Table 1 below.

TABLE 1

| | Characteristics of FRM | |
|---|---|---|
| | Bending strength ($kg/cm^2$) | Modulus of bending elasticity ($T/mm^2$) |
| Example 1 | 105 | 21 |
| Comparative Example 1 | 80 | 19 |

We claim:

1. A method for production of fiber-reinforced metal composite material, characterized by the steps of: impregnating a bundle of fibers with water; then compressing and freezing said water-impregnated fiber bundle to form a high density fiber shaped body; subsequently thawing and drying said high density fiber shaped body, while maintaining its shape as compressed; and thereafter pouring molten metal into said fiber shape body.

2. The method for production of fiber-reinforced metal composite material according to claim 1, characterized in that the fiber material to form said fiber bundle is silicon carbide filter, aluminum oxide fiber, boron fiber, or carbon fiber.

3. The method for production of fiber-reinforced metal composite material according to claim 1, characterized in that the metal material for said molten metal is aluminum, magnesium, copper, or alloys thereof.

* * * * *